US005942816A

United States Patent [19]

Carter

[11] Patent Number: 5,942,816

[45] Date of Patent: Aug. 24, 1999

[54] PRECAUTIONARY TIMER FOR KITCHEN RANGE SURFACE ELEMENTS

[76] Inventor: Jack J. Carter, 32 Park Drive, Chatham, New Brunswick, Canada, E1N 2Y9

[21] Appl. No.: 09/095,317

[22] Filed: Jun. 10, 1998

[51] Int. Cl.[6] ..... H01H 7/00

[52] U.S. Cl. ..... 307/141; 307/139; 307/141.4; 219/492

[58] Field of Search ..... 307/112, 113, 307/116, 125, 130, 131, 139, 140, 141, 141.4, 141.8, 147; 361/88–97, 195, 196; 337/225; 219/490, 491, 492, 493

[56] References Cited

U.S. PATENT DOCUMENTS

| | | | |
|---|---|---|---|
| 1,758,619 | 5/1930 | Phillips | 219/492 |
| 2,599,171 | 6/1952 | Freeman | 200/33 B |
| 3,767,937 | 10/1973 | Schmidgall | 361/198 |
| 3,819,906 | 6/1974 | Gould, Jr. | 219/506 |
| 4,742,246 | 5/1988 | Mori | 307/141.4 |
| 4,769,556 | 9/1988 | Meisner | 307/141.8 |
| 4,777,384 | 10/1988 | Altenhof et al. | 307/141 |
| 4,782,420 | 11/1988 | Holdgaard-Jensen | 361/58 |
| 5,693,245 | 12/1997 | Clizbe | 219/492 |

FOREIGN PATENT DOCUMENTS

| | | |
|---|---|---|
| 819664 | 1/1972 | Canada . |
| 2219152 | 11/1989 | United Kingdom . |

*Primary Examiner*—Jeffrey Gaffin
*Assistant Examiner*—Jonathan S. Kaplan
*Attorney, Agent, or Firm*—Mario D. Theriault

[57] ABSTRACT

A precautionary timer for installation in a kitchen range, as a replacement of a plug-type fuse protecting one of the heating elements of the kitchen range. In a first aspect of the invention, the precautionary timer comprises a threaded fuse stock having first and second electrically conductive terminals set apart from one another, and conductive segments mounted inside the threaded fuse stock and connected to the first and second terminals. A timing unit comprising a low voltage solid state timer and an electronic switch is also mounted inside the threaded fuse stock. The solid state timer is powered by a current transformer sampling power from the current flowing in one of the conductive segments. The semiconductor switch is connected in series with the conductive segments and the first and second terminals, for selectively electrically connecting and disconnecting the first and second terminals to and from one another.

20 Claims, 2 Drawing Sheets

PRECAUTIONARY TIMER FOR KITCHEN RANGE SURFACE ELEMENTS

FIELD OF THE INVENTION

This invention pertains to a timer for controlling the operation of a kitchen range surface element, and more particularly, this invention pertains to a timing device mounted in a threaded fuse stock for installation in a plug-type fuse socket of a kitchen range.

BACKGROUND OF THE INVENTION

The surface elements of a kitchen range represent a serious fire hazard when operated by people having a tendency to forget or to be easily distracted. Furthermore, the cooking of food by people suffering from memory incapacitating illnesses such as the Alzheimer's disease is another serious hazard and an important cause of property damage and death by fire each year.

Several manufacturers of kitchen ranges have recognized the need for more safety with kitchen ranges, and have added timers to the circuitry of their appliances. Thanks be given to those manufacturers, several models of modem kitchen ranges are now available with timing devices for automatically shutting off any one of the surface elements after a preset cooking period.

Examples of timing devices incorporated in the control circuitry of the surface elements of kitchen ranges are disclosed in the following documents:

U.S. Pat. No. 1,758,619, issued on May 13, 1930 to R. M. G. Phillips;

U.S. Pat. No. 2,599,171, issued on Jun. 3, 1952 to H. F. Freeman;

U.S. Pat. No. 3,819,906, issued on Jun. 25, 1974 to Robert G. Goulds;

U.S. Pat. No. 4,769,556, issued on Sep. 6, 1988 to Alfred Meisner;

U.S. Pat. No. 5,693,245, issued on Dec. 2, 1997 to Kent Clizbe;

UK Patent Appl. 2,219,152, filed on Apr. 5, 1989 by Diehl GmbH & Co.

Although some modern kitchen ranges have timers to control the surface elements thereof, the timers used in these ranges are not adapted for retrofit installations on the basic models of kitchen ranges. A typical kitchen range may have a useful life of 30 years or more. Therefore, there is still and will be for a number of years, an immense quantity of appliances which do not have any timing device therein.

Also, the timers used in the modern kitchen ranges are not always as durable as the remaining portion of the appliances. When a timer fails, it is often the case that the owner of the range neglects to repair or replace the defective parts and continues to operate the range without this safety feature.

Therefore, it is believed that there is a significant market demand for a timing device which can be installed in kitchen ranges as a precautionary measure to control the operation of the surface elements, whether it is a modern range or an older durable type. It is believed that there is a large market demand for a retrofit timing device for installation in kitchen ranges if that timing device can be easily installed by a homeowner, landlord or a hospice attendant for examples without having to modify the wiring of the appliance.

SUMMARY OF THE INVENTION

In the present invention, however, there is provided, a precautionary timer for installation in kitchen ranges, as a replacement of a plug-type fuse protecting one of the surface elements of a kitchen range.

In a first aspect of the present invention, the precautionary timer comprises broadly; a threaded fuse stock having first and second electrically conductive terminals set apart from one another, and conductive segments mounted in the threaded fuse stock and connected to the first and second terminals. A timing unit comprising a low voltage solid state timer and a semiconductor switch is also mounted in the threaded fuse stock. The semiconductor switch is connected in series with the conductive segments and the first and second terminals, for selectively electrically connecting and disconnecting the first and second terminals to and from one another. The timing device further comprises a cover mounted over the threaded fuse stock for sealing the conductive segments and the timer unit inside the threaded fuse stock.

A major advantage of the timing device of the present invention is that it is easily mountable in a plug-type fuse socket of a range-top element, for timely controlling an operation of the range-top element. The installation of the timing device of the present invention is a subtle one wherein the imprudent users of a kitchen range can hardly notice that a precautionary timer has been substituted for a common fuse.

The precautionary timer of the present invention is particularly advantageous as a precautionary accessory for supervising the cooking of food by people having a tendency to be easily distracted such as unsupervised children, university students and adults having too much on their mind. As mentioned in the foregoing, the precautionary timer is also an invaluable safety device for supervising the cooking of food by people suffering from memory incapacitating illnesses such as the Alzheimer's disease.

The precautionary timer of the present invention is also appreciable for installation in kitchen ranges used in lunch rooms of industries or in common access kitchenettes of health care facilities for examples where the cooking time of food is never a long period.

In accordance with another aspect of the precautionary timer of the present invention, there is provided therein an overload circuit breaker connected in series with the conductive segments of the device. The electrical protection afforded by the original equipment manufacturer is thereby maintained.

In accordance with yet another aspect of the precautionary timer of the present invention, there is provided a timing device for installation in a plug-type fuse socket connected to an electrical circuit of electrical equipment of various types including equipment other than kitchen ranges. The timing device comprises a threaded fuse stock having first and second electrically conductive terminals set apart from one another. A cover is mounted over the threaded fuse stock for sealing the first and second terminals inside the threaded fuse stock.

A timing module is also provided and comprises a low voltage solid state timer with variable time setting control capabilities and an electronic switch mounted therein. A plurality of conductive segments extends through the cover of the threaded fuse stock and is connected in series with the first and second terminals of the threaded fuse stock and with the electronic switch, for selectively electrically connecting and disconnecting the first and second terminals to and from one another.

The precautionary timer of this aspect of the present invention is manufacturable with heavy duty components for installation in industrial or commercial electrical equipment having plug-type fuse sockets and requiring a timing control feature.

BRIEF DESCRIPTION OF THE DRAWINGS

The preferred embodiments of the present invention will be further understood from the following description, with reference to the drawings in which.

DETAILED DESCRIPTION OF THE PREFERRED EMBODIMENT

Figure 1:
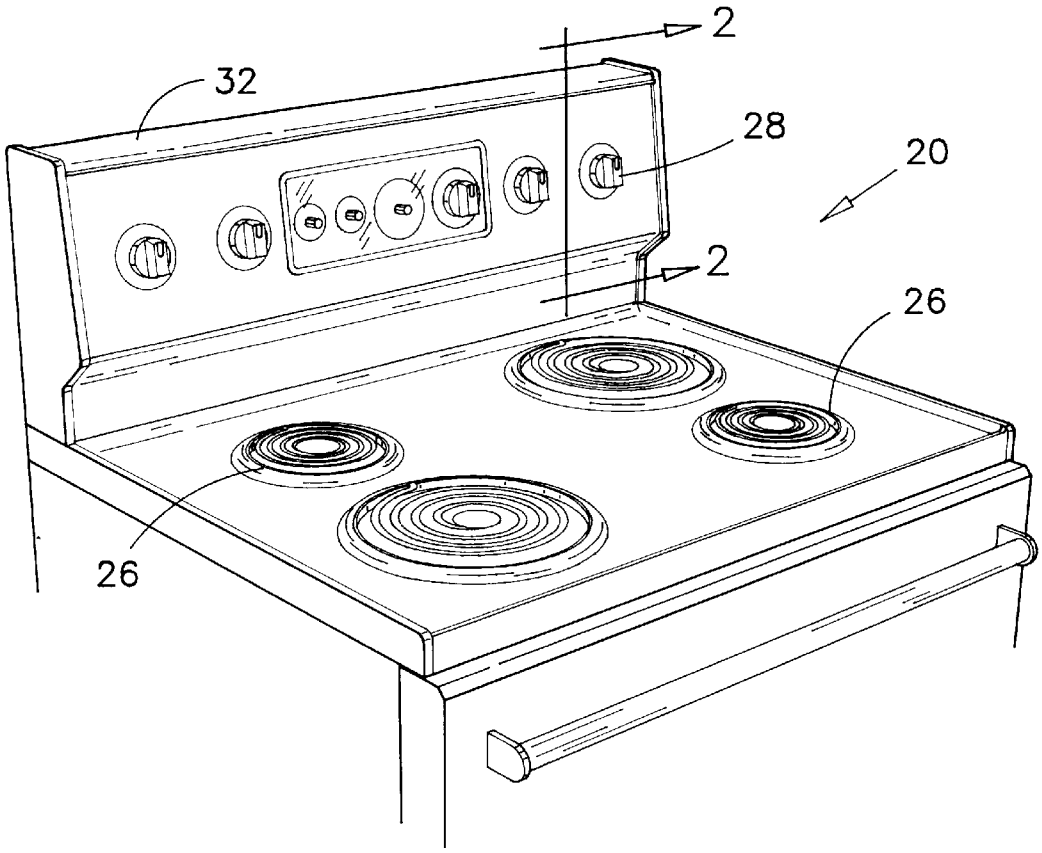
FIG. 1 illustrates a typical basic kitchen range having an instrument console and a fuse compartment inside the instrument console.
Figure 3:
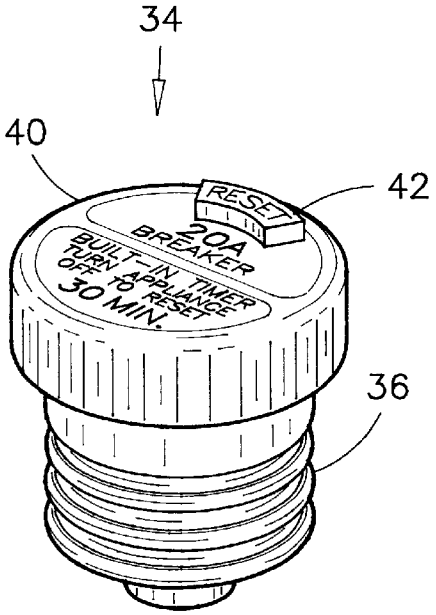
FIG. 3 is an enlarged first perspective side and top view of the precautionary timer of the first preferred embodiment.
Figure 2:
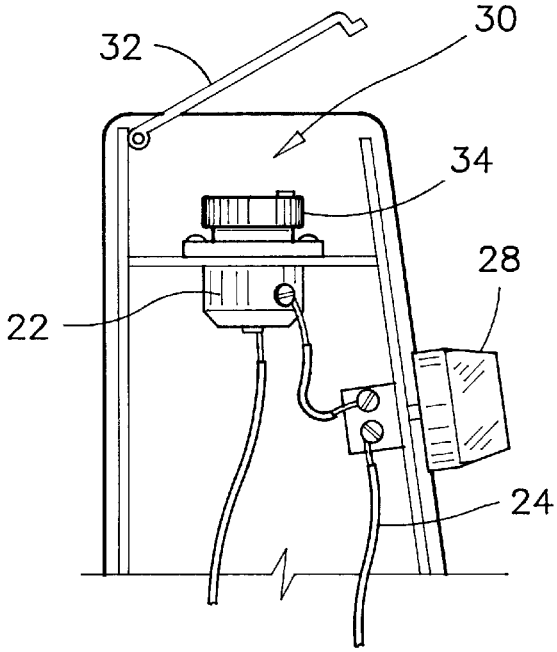
FIG. 2 is a cross-section view of the fuse compartment inside the instrument console of the basic kitchen range illustrated in FIG. 1, as seen along line 2—2 in FIG. 1.
Figure 4:
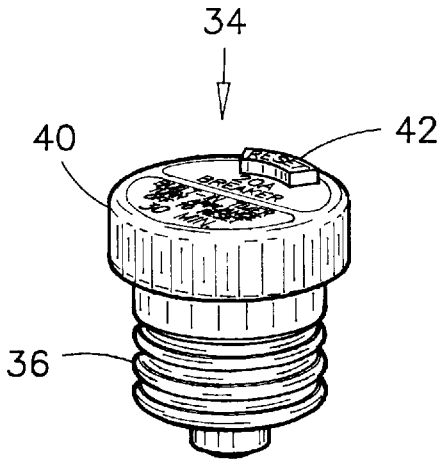
FIG. 4 is a second perspective side and top view of the precautionary timer of the first preferred embodiment.
Figure 5:
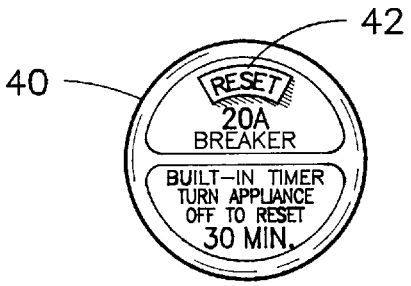
FIG. 5 is a top view of the precautionary timer illustrated in FIGS. 3 and 4.

For reference purposes, there is illustrated in FIGS. 1, and 2, a typical basic kitchen range 20 and a typical location of the fuse socket 22 comprised in the circuitry 24 of one of the surface elements 26 of that kitchen range. Generally, the fuse socket 22 is connected in series with an ON-OFF rheostat switch 28 for controlling the heat intensity of the surface element 26. In many basic models of kitchen ranges, the fuse sockets 22 are mounted in a fuse compartment 30 inside the instrument panel. The fuse compartment 30 is normally accessible by a hinged or clip-on lid 32 covering the top portion of the instrument panel. In most models of kitchen ranges, each surface element 26 is individually fused.

Referring now particularly to FIGS. 3, 4, 5 and 6, the precautionary timer 34 of the first preferred embodiment comprises a threaded fuse stock 36 enclosing or partly enclosing a timing circuit comprising an overload circuit breaker 38, and a cap member 40 sealing the timing circuit and the circuit breaker 38 inside and over the threaded fuse stock 36. The threaded metal stock 36 has the same dimensions as the threaded stock on a common plug-type fuse such that the precautionary timer 34 of the first preferred embodiment is mountable in a fuse socket as a replacement of a common plug-type fuse.

The precautionary timer 34 of the first preferred embodiment is manufacturable with circuit breakers 38 of different current ratings, and with timers having different fixed time settings, in order to satisfy a variety of different applications and circumstances.

The circuit breaker 38 in the precautionary timer of the first preferred embodiment is preferably a re-closable type circuit breaker having a reset button 42 protruding from the top surface of the cap member 40. The electrical protective feature of the kitchen range as originally provided by the manufacturer of the equipment is maintained by the circuit breaker 38.

Figure 6:
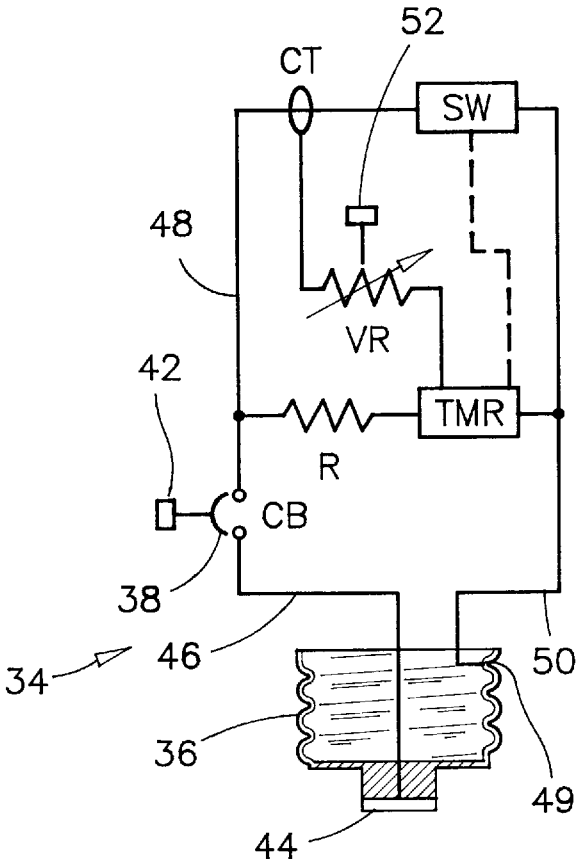
FIG. 6 is a schematic diagram of the circuit inside the precautionary timers of the first or second preferred embodiments.

The safety aspect of the kitchen range as originally manufactured is further enhanced by the timing circuit, as illustrated in FIG. 6. The timing circuit of the precautionary timer 34 of the first preferred embodiment has a first conductive segment 46, connected between the bottom terminal 44 of the threaded metal stock 36 and the circuit breaker 38. The circuit breaker 38 is connected in series with a silicon controlled rectifier 'SW' by means of a second conductive segment 48. The silicon controlled rectifier 'SW' is often referred to in the trade as a triac or semiconductor switch. The term 'electronic switch' used hereinafter to designate this switch 'SW' is intended to encompass all the devices listed above as well as other electronically switchable devices known to those knowledgeable in the art. A third conductive segment 50 connects the electronic switch 'SW' to the stock's casing, in other words to the second terminal 49 of the threaded stock 36, in order to close a circuit between the bottom terminal 44 and the casing terminal 49, through the circuit breaker 38 and the electronic switch 'SW'.

In operation, the electronic switch 'SW' is controlled by a solid state low voltage timing device 'TMR', for causing the electronic switch 'SW' to open when a preset time period has expired. The solid state timing device 'TMR' is operated by a current transformer 'CT' mounted about any one of the conductive segments 46 and 48 of the timing circuit, before the electronic switch 'SW'. The solid state timing device 'TMR' is operable on very low voltage such as five volts for example, and the current transformer 'CT' is selected to sample from the current flowing in the timing circuit, an adequate amount of power to operate the timing device 'TMR' over the full range of currents passing through the timing circuit, and as set by the ON-OFF rheostat switch 28.

The solid state timing device 'TMR' is connected in series with a voltage reducing resistor 'R'. This combination is connected between the second and third conductive segments 48,50, in parallel with the electronic switch 'SW'. The timing device 'TMR' draws a minimum amount of power from the circuit when the electronic switch 'SW' is open and there is no current flowing through the current transformer 'CT'. The purpose of resistor 'R' is for preventing a high current from flowing through the range-top element 26 when the timing device 'TMR' has timed out and has caused the electronic switch 'SW' to open the circuit. The resistive value of resistor 'R' is selected such that the current flowing through the range-top element 26, when the electronic switch 'SW' is open, preferably produces a below minimum heat intensity in the range-top element 26. The timing device 'TMR' remains energized, and locked-in as long as the ON-OFF rheostat switch 28 remains in the ON mode and the third conductive segment 50 is able to find a way to ground. This feature prevents the electronic switch 'SW' from re-closing the circuit as long as the kitchen range remains unattended.

As soon as the ON-OFF rheostat switch 28 is turned OFF, however, the timing device 'TMR' is de-energized for losing its path to ground, allowing the electronic switch 'SW' to close and the surface element 26 to resume an operating mode. Thus, the precautionary timer of the first preferred embodiment is reset only when a user of the range manually turns the ON-OFF rheostat switch 28 to an OFF mode.

It will be appreciated that the current transformer 'CT' may be connected to an optional variable resistor 'VR' as illustrated in FIG. 6, to vary the voltage to the solid state timing device 'TMR' and to provide a means for adjusting the timing period of the timing device.

The precautionary timer 34 of the first preferred embodiment is mountable in the fuse socket 22 of a surface element 26 to interrupt the current to that surface element as soon as the preset time value of the timer has been reached. The precautionary timer 34 of the first preferred embodiment is particularly advantageous for its easy installation. It simply screws into the fuse socket in the wiring circuit of a surface element as a replacement of the original fuse. The installation of the precautionary timer 34 does not require the specialized knowledge of an electrician and does not require modification to the actual wiring of a kitchen range.

The installation of the precautionary timer 34 of the first preferred embodiment in a kitchen range may be done by a landlord renting apartments to students for example, by caregiver tending to elderly people cooking their own food or as a temporary installation by parents leaving their grown-up kids alone for a weekend.

Figure 7:
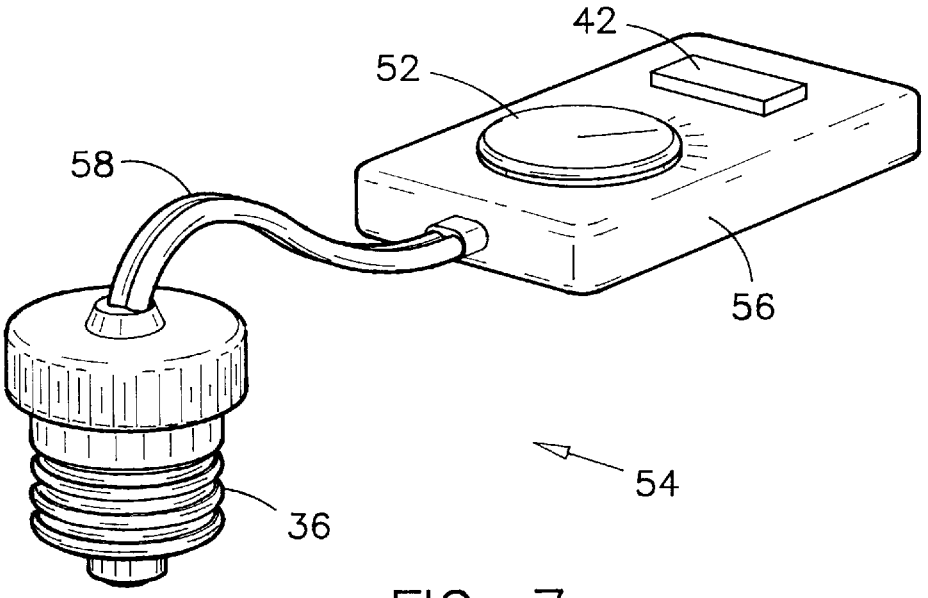
FIG. 7 is a perspective side view of the precautionary timer of the second preferred embodiment.

Referring now to FIG. 7, the precautionary timer of the second preferred embodiment 54 is illustrated therein. The precautionary timer of the second preferred embodiment preferably has a time selector knob 52 for adjusting the maximum duration of a cooking period. This time selector knob is connected to the variable resistor 'VR' as mentioned above, and as illustrated in FIG. 6. The precautionary timer of the second preferred embodiment comprises a threaded fuse stock 36 and a solid state timer module 56 which are connected to the threaded fuse stock 36, by means of an electrical flexible conductor 58. Otherwise, the timing circuit in the precautionary timer of the second preferred embodiment is similar to the timing circuit in the first preferred embodiment, as illustrated in FIG. 6.

The precautionary timer of the second preferred embodiment is advantageous for mounting in a kitchen range where a cooking period adjustment is required. And of course, the configuration of the precautionary timer of the second preferred embodiment is convenient for manufacturing a timing device containing heavy duty components for installation in industrial equipment or appliances other than kitchen ranges.

The precautionary timer of the first and second preferred embodiments are compact in size and may advantageously be installed and concealed inside the fuse compartment of a kitchen range. These precautionary timers are invaluable safety accessories for preventing building fires associated with inadvertent use of a kitchen range or similar appliances protected by plug-type fuses.

While the above description provides a full and complete disclosure of the preferred embodiments of the precautionary timers of the present invention, various modifications and equivalents may be employed without departing from the true spirit and scope of the invention. Such changes might involve alternate structural arrangements, sizes, construction features and the like. Therefore, the above description and the illustrations should not be construed as limiting the scope of the present invention which is defined by the appended claims.

I claim:

1. A timing device for installation in a plug-type fuse socket connected to an electrical circuit, comprising:

a threaded fuse stock having first and second electrically conductive terminals set apart from one another;

electrically conducting means mounted in said threaded fuse stock and connected to said first and second terminals;

timing means also mounted in said threaded fuse stock and having a circuit opening means connected in series with said conducting means and said first and second terminals for selectively electrically connecting and disconnecting said first and second terminals to and from one another; and covering means mounted on said threaded fuse stock for sealing said conducting means and said timing means inside said threaded fuse stock;

such that said timing device is mountable in a plug-type fuse socket connected to an electrical circuit, for timely controlling an operation of said electrical circuit.

2. The timing device as claimed in claim 1, further comprising an overload circuit breaker connected in series with said conducting means.

3. The timing device as claimed in claim 2 further comprising a reset button connected to said overload circuit breaker and protruding through said covering means.

4. The timing device as claimed in claim 1, wherein said timing means comprises a solid state timer operable on low voltage.

5. The timing device as claimed in claim 4 wherein said circuit opening means comprises an electronic switch.

6. The timing device as claimed in claim 5, further comprising a current transformer mounted about said conducting means for sampling power from a current passing through said conducting means when said current is adapted to be passed through said conducting means, and said current transformer being connected to said solid state timer for supplying said power to said solid state timer.

7. The timing device as claimed in claim 6 further comprising a resistor connected in series with said solid state timer, and said resistor and said solid state timer being connected in parallel with said electronic switch.

8. The timing device as claimed in claim 7, further comprising a variable resistor connected between said current transformer and said solid state timer for varying an intensity of said power supplied by said current transformer to said solid state timer.

9. The timing device as claimed in claim 7 further comprising an overload circuit breaker and said conducting means comprising a first, second and third conductive segments; said first conductive segment being connected to said first terminal and to said overload circuit breaker, said second conductive segment being connected between said overload circuit breaker and said electronic switch, and said third segment being connected between said electronic switch and said second terminal.

10. The timing device as claimed in claim 9, wherein said resistor and said solid state timer being connected between said second conductive segment and said third conductive segment.

11. In combination, a kitchen range having a surface element, an electrical power supply circuit connected to said surface element and having a plug-type fuse socket, and a timing device connected into said fuse socket;

said timing device comprising:

a threaded fuse stock having first and second spaced apart terminals being electrically connected to said fuse socket and configuration and dimension for allowing a threaded engagement thereof into said fuse socket;

electrically conducting means connected to said first and second terminals; and timing means having a circuit opening means connected in series with said conducting means and with said first and second terminals of said threaded fuse stock for selectively electrically connecting and disconnecting said first and second terminals;

whereby said surface element is disconnect able from said electrical circuit when a time setting of said timing means has been reached.

12. The combination as claimed in claim 11, wherein said timing device comprises a timer module containing said timing means, and said conducting means extends outside said threaded fuse stock to said timer module.

13. The combination as claimed in claim 12, wherein said timing means comprises time adjustment means.

14. The combination as claimed in claim 13, wherein said time adjustment means comprises an adjustment knob protruding from a surface of said timer module.

15. The combination as claimed in claim 12, wherein said timer module further comprises an overload circuit breaker.

16. The combination as claimed in claim 15, wherein said overload circuit breaker also comprises a reset button protruding from a surface of said timer module.

17. The combination as claimed in claim 12, wherein said conducting means comprises a flexible conductor.

18. The combination as claimed in claim 11, wherein said timing means comprises a solid state timer operable on low voltage, and said circuit opening means comprises an electronic switch.

19. A timing device for installation in a plug-type fuse socket connected to an electrical circuit, comprising:

a threaded fuse stock having first and second electrically conductive terminals set apart from one another;

electrically conducting means connected to said first and second terminals;

timing means having a circuit opening means connected in series with said conducting means and said first and second terminals for selectively electrically connecting and disconnecting said first and second terminals to and from one another; and covering means mounted on said threaded fuse stock for sealing said threaded fuse stock;

such that said timing device is mountable in a plug-type fuse socket connected to an electrical circuit, for timely controlling an operation of said electrical circuit.

20. The timing device as claimed in claim 19, wherein said timing means comprises a timer module containing said timing means, and said conducting means extends outside said threaded fuse stock through said covering means to said timer module.

* * * * *